US005860475A

United States Patent [19]

Ejiogu et al.

[11] Patent Number: 5,860,475

[45] **Date of Patent: *Jan. 19, 1999**

[54] MIXED WELL STEAM DRIVE DRAINAGE PROCESS

[75] Inventors: Godwin Ejiogu, Calgary; Paul R. Sander, Estevan; William J. McCaffrey, Calgary, all of Canada

[73] Assignee: Amoco Corporation, Chicago, Ill.

[ * ] Notice: The term of this patent shall not extend beyond the expiration date of Pat. No. 5,417,283.

[21] Appl. No.: 316,937

[22] Filed: Dec. 8, 1994

Related U.S. Application Data

[63] Continuation-in-part of Ser. No. 234,174, Apr. 28, 1994, Pat. No. 5,417,283.

[51] Int. Cl.[6] ..... E21B 43/24; E21B 43/30

[52] U.S. Cl. ..... 166/245; 166/50; 166/252.2; 166/263; 166/272.2; 166/272.3; 166/272.7

[58] Field of Search ..... 166/50, 245, 250.01, 166/252.1, 252.2, 263, 272.2, 272.3, 272.6, 272.7, 303

[56] References Cited

U.S. PATENT DOCUMENTS 3,294,167 12/1966 Vogel .
3,385,359 5/1968 Offeringa .

(List continued on next page.)

FOREIGN PATENT DOCUMENTS 1130201 8/1982 Canada .

OTHER PUBLICATIONS

Pooladi–Darvish, M., Farouq Ali, S. M. and Tortike, W. F., "Behavior of Gravity Drainage in Heavy Oil Fractured Reservoirs Under Steam Injectiion", *6th UNITAR International Conference on Heavy Crude and Tar Sands*, Feb. 12 through 17, 1995, Houston, Texas, USA, vol. 1, pp. 775 through 786.

Redford D. A., "In Situ Recovery from the Athabasca Oil Sands—Past Experience and Future Potential", *Journal of Canadian Petroleum Technology*, V25, No. 3, May through Jun. 1985, pp. 52 through 62.

Redford D. A. and Luhning R. W., "In Situ Recovery from the Athabasca Oil Sands—Past Experience and Future Potential, Part II", *Petroleum Society of CIM*, 46th Annual Technical Meeting, Banff, Alberta, Canada, May 14 through 17, 1995, Paper 95–24.

Nasr T. N., "Analysis Of Thermal Horizontal Well Recovery and Horizontal Well Bibliography", Nov. 1990, *Alberta Research Council Oil Sands and Hydrocarbon Recovery Report #90191–12*.

Butler, R. M.; McNab, G. S.; and Lo, H. Y., "Theoretical Studies on the Gravity Drainage of Heavy Oil During In–Situ Steam Heating", *The Canadian Journal of Chemical Engineering*, vol. 59, Aug. 1981, pp. 455 through 460.

"1995/96 Abandonment, Fund Annual Report" from the Alberta Energy and Utilities Board. Oct. 21, 1996.

Roger, Butler, "The Potential for Horizontal Wells for Petroleum Production," *The Journal of Canadian Petroleum Technology*, May–Jun. 1989, vol. 28, No. 3, pp. 39 through 47.

(List continued on next page.)

*Primary Examiner*—George A. Suchfield
*Attorney, Agent, or Firm*—James A. Gabala; Robert E. Sloat

[57] ABSTRACT

A thermal oil recovery process is disclosed for use in a heavy oil reservoir having a plurality of laterally separated, generally vertical wells whose use have left the reservoir characterized by a heated depletion zone, a channel, voidage, or mobility and communication. The process includes the steps of: drilling a well having a horizontal section and an opening therein that is located laterally between at least two of the vertical wells and at a depth within the lower part of the reservoir; injecting a steam through the two vertical wells to establish thermal communication with said horizontal well; and using the combination of steam drive and gravity drainage to recover oil from the reservoir through the horizontal well.

41 Claims, 2 Drawing Sheets

U.S. PATENT DOCUMENTS

| | | | |
|---|---|---|---|
| 3,434,544 | 3/1969 | Satter et al. | 166/303 |
| 4,116,275 | 9/1978 | Butler et al. | 166/303 |
| 4,175,618 | 11/1979 | Wu et al. | 166/252 |
| 4,249,604 | 2/1981 | Frazier | 166/263 |
| 4,265,310 | 5/1981 | Britton et al. | 166/272.3 X |
| 4,344,485 | 8/1982 | Butler | 166/271 |
| 4,390,067 | 6/1983 | Willman | 166/245 |
| 4,410,216 | 10/1983 | Allen | 299/2 |
| 4,445,573 | 5/1984 | McCaleb . | |
| 4,445,574 | 5/1984 | Vann | 166/268 |
| 4,460,044 | 7/1984 | Porter | 166/252 |
| 4,463,988 | 8/1984 | Bouck et al. | 299/2 |
| 4,503,911 | 3/1985 | Hartman . | |
| 4,530,401 | 7/1985 | Hartman | 166/303 |
| 4,598,770 | 7/1986 | Shu et al. | 166/245 |
| 4,646,824 | 3/1987 | Huang et al. | 166/50 X |
| 4,682,652 | 7/1987 | Huang et al. | 166/263 |
| 4,718,485 | 1/1988 | Brown et al. | 166/50 |
| 4,858,587 | 8/1989 | Nielson . | |
| 4,869,830 | 9/1989 | Konak et al. | 210/708 |
| 4,982,786 | 1/1991 | Jennings, Jr. | 166/50 |
| 5,013,462 | 5/1991 | Danley . | |
| 5,016,709 | 5/1991 | Combe et al. | 166/245 |
| 5,033,546 | 7/1991 | Combe | 166/245 |
| 5,058,681 | 10/1991 | Reed | 166/303 |
| 5,148,869 | 9/1992 | Sanchez | 166/303 |
| 5,167,280 | 12/1992 | Sanchez et al. | 166/267 |
| 5,211,230 | 5/1993 | Ostapovich et al. | 166/245 |
| 5,215,146 | 6/1993 | Sanchez | 166/263 |
| 5,238,066 | 8/1993 | Beattie et al. | 166/303 |
| 5,244,041 | 9/1993 | Renard et al. | 166/268 |
| 5,273,111 | 12/1993 | Brannan et al. | 166/245 |
| 5,282,508 | 2/1994 | Ellingsen et al. | 166/249 |
| 5,305,829 | 4/1994 | Kumar | 166/245 |
| 5,339,897 | 8/1994 | Leaute | 166/245 |
| 5,417,283 | 5/1995 | Ejiou et al. | 166/50 X |
| 5,450,902 | 9/1995 | Matthews | 166/268 |

OTHER PUBLICATIONS

Roger, Butler, *Thermal Recovery of Oil and Bitumen* (originally published in 1991 by Prentice–Hall Inc. and re–published in 1997 by Gravdrain Inc.), Table of Contents, Chapter 4, and pp. 321–329.

K. C. Hong, *Steamflood Reservoir Management Thermal Enhanced Oil Recovery* (published in 1994 by Penn Well Publishing Company), Table of Contents, Chapter 10.

Soda D. Joshi, *Horizontal Well Technology* (published in 1991 by Penn Well Publishing Company), Table of Contents, pp., 48–61, Chapter 5.

V. Hansamuit and J. A. Abov–Kassem, "Performance of Steam Injection Processes Using Vertical and Horizontal Wells," *Enhanced Oil Recovery*, No. 280, vol. 87, AIChE Symposium Series 1991, published by American Institute of Chemical Engineers.

MIXED WELL STEAM DRIVE DRAINAGE PROCESS

CROSS REFERENCE TO RELATED APPLICATION

This patent application is a continuation-in-part of a U.S. patent application having a Ser. No. 08/234,174, filed on Apr. 28, 1994, entitled "Mixed Well Steam Drive Drainage Process," and issued as U.S. Pat. No. 5,417,283 on May 23, 1995.

TECHNICAL FIELD

This invention relates to the general subject of production of oil and, in particular, to a process or method for enhanced recovery of oil in underground formations which have previously experienced cyclic steam stimulation.

BACKGROUND OF THE INVENTION

There exists throughout the world major deposits of heavy oils which, until recently, have been substantially ignored as sources of petroleum since the oils contained therein were not recoverable using ordinary production techniques. For example, it was not until the 1980's that much interest was shown in the heavy oil deposits of the Alberta province in Canada even though many deposits are close to the surface and represent an estimated petroleum resource upwards of many billion barrels.

It is well-known that heat can be employed to recover hydrocarbons from underground formations through wells drilled in the underground petroleum deposits. Various methods have been developed over the years for primary and secondary recovery of oil from underground formations by thermal means.

Moreover, it is well recognized by persons skilled in the art of recovering oil or petroleum from subterranean deposits that only a small fraction of the viscous petroleum may be recovered from subterranean formations by conventional, primary and secondary means. Some method, such as a thermal recovery process or other treatment, must often be applied to the formation to reduce the viscosity of the petroleum and increase the reservoir pressure to levels where it will readily flow to wells from which it can be brought to the surface of the earth. Steam and/or hot water flooding are commonly used for this purpose and have been very successful in some formations for stimulating recovery of viscous petroleum which is otherwise essentially unrecoverable. Steam flooding is a thermal oil recovery method which has enjoyed increased popularity in recent years and is often the most commercially practical method or process.

Huff-and-puff and Cyclic Steam Stimulation (CSS) are applications of steam flooding. CSS and "huff-and-puff" involve injecting steam into a vertical well, then shutting in the well for a "soak," wherein the heat contained in the steam raises the temperature and lowers the viscosity of the petroleum. Thereafter, a production period begins wherein mobilized petroleum is produced from the well, usually by pumping. This process is repeated over and over again until the production index becomes smaller than a minimum profitable level.

Steam flooding may also be utilized as a steam or thermal drive means or a steam through-put process, wherein steam is injected into the reservoir through one or more vertical injection wells. This steam then moves through the subterranean reservoir mobilizing the petroleum it encounters. This steam-flood front moves through the reservoir towards a production well from which the petroleum fluids are produced. This steam drive process is often more effective than the "huff-and-puff" method inasmuch as the potential volume of the reservoir which can be swept by the process is greater.

Although the steam drive process is very effective in recovering petroleum from the portions of the reservoir through which the steam sweeps, in practice, the success of the steam drive method is often poorer because of the process' inability to develop liquid communication and because of low vertical and areal conformance efficiency. It is typical that less than 35% of petroleum contained within a formation can be recovered by the steam drive process thereby leaving large amounts of petroleum within the reservoir after the completion of the process.

One of the problems faced with thermal oil recovery method arises from the varying permeabilities of the reservoir. Where there is a permeable zone with a considerable increase in permeability when compared to the oil-bearing strata, the injected steam will flow into the permeable zone preferentially, or, on occasion, almost exclusively. Another problem encountered is the loss of a portion of the heat already transferred to the oil-bearing strata by the steam as a result of conduction away into the overburden. Clearly improvements are needed.

SUMMARY OF THE INVENTION

A general object of the invention is to improve the low ultimate recovery experienced with cyclic steam stimulation.

Yet another objective of the invention is to provide an improved means for recovery of oil that utilizes existing cyclic steam stimulation infra-structure.

Still another object of the invention is to provide a new process for the recovery of oil from undeveloped oil sands.

In accordance with the present invention, a thermal recovery process is disclosed for use in a heavy oil reservoir containing a plurality of laterally separated, generally vertical wells whose use have left the reservoir characterized by a heated depletion zone, a channel, voidage or oil that is mobil and communicative within the reservoir, the reservoir having a top and a bottom and each vertical well having a lower end located within at least part of the reservoir. In one embodiment the process comprises the steps of: drilling a well having a horizontal section and an opening therein that is located laterally between at least two of the vertical wells and at a depth within the lower part of the reservoir; injecting a heated fluid through the two vertical wells to establish thermal communication with the horizontal well, the location where the heated fluid leaves the lower ends of the vertical wells being relatively close to the opening in the horizontal section; and using the pressure drive of said heated fluid and gravity drainage to recover oil from the reservoir through the horizontal well.

The invention may be considered as a follow-up process to the recovery of oil from a reservoir wherein cyclic steam stimulation had been used. It utilizes existing infrastructure and previously formed channels, fractures and/or wormholes for accelerated recovery, resulting in higher productivity and more economical recovery. This improvement is due, in part, to the utilization of a new horizontal well, the use of existing vertical or deviated wells and pad facilities, and the use of a combination of steam drive and gravity drainage process. A horizontal well has a greater effect than drilling more vertical wells. In other words, a properly positioned horizontal well should produce a greater percentage of the oil in the reservoir at a lower cost, and at a rate which could only be matched by drilling multiple new vertical wells.

Moreover, the combination of steam drive and gravity drainage results in the formation of a steam chamber, which provides higher oil rates and low steam-to-oil ratios. The result is an improved oil recovery of at least 50%.

Numerous other advantages and features of the present invention will become readily apparent from the following detailed description of the invention, from the embodiments described therein, from the claims, and from the accompanying drawings.

DETAILED DESCRIPTION

Figure 1:
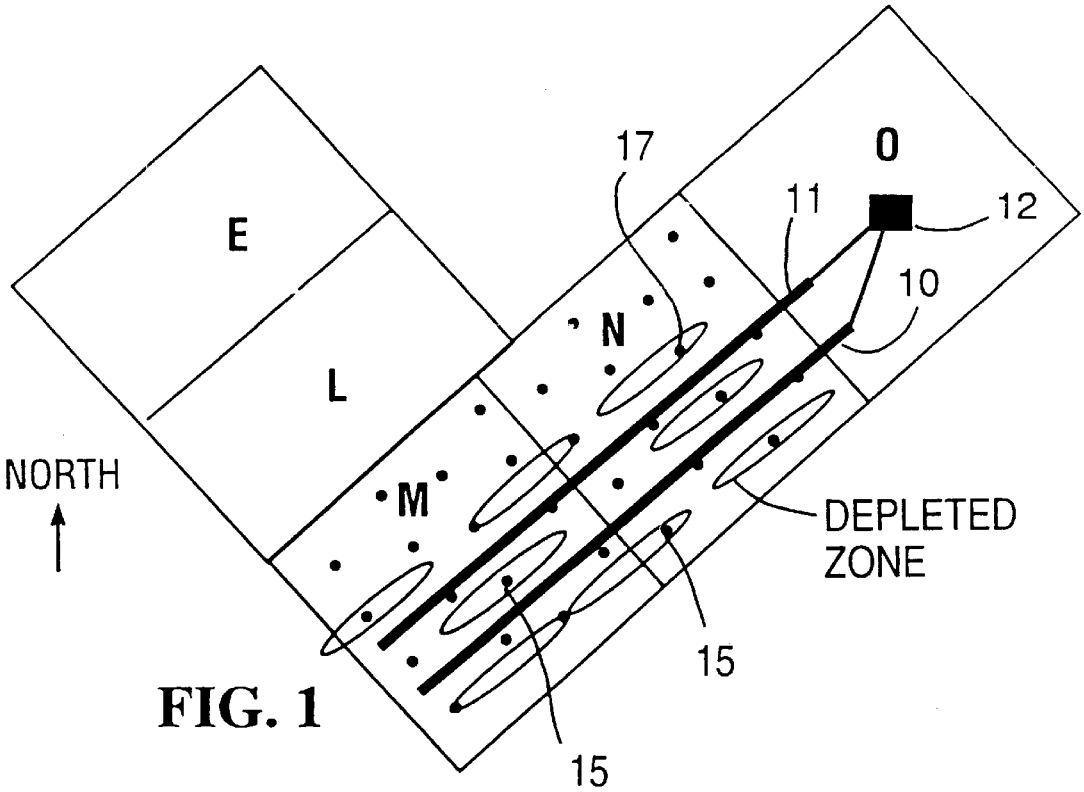
FIG. 1 is a plan view of one arrangement of vertical and horizontal wells for the process that is the subject of the present invention.

While this invention is susceptible of embodiment in many different forms, there is shown in the drawings, and will herein be described in detail, one specific embodiment of the invention. It should be understood, however, that the present disclosure is to be considered an exemplification of the principles of the invention and is not intended to limit the invention to the specific embodiment illustrated. In this sense it should be understood that the term "vertical well" is not limited to wells drilled exactly at ninety degrees to the earth's surface. Slant wells, directionally drilled wells and laterally drilled wells that deviate within thirty to sixty degrees of true vertical are to be included.

This invention is, for the most part, a follow-up process to cyclic steam stimulation (CSS). However, the process of the invention could be applied to reservoirs previously produced by cold primary production methods. Voidage created by prior production is beneficial as it results in enhanced steam injectivity. The process could also be applied to a virgin reservoir. For example, where vertical exploration and delineation wells have been drilled to locate and evaluate the extent of a reservoir, the process could be applied to take advantage of the existence of such wells. Also as a further example, the process could be applied in situations where primary or cold production has been attempted using substantially vertical wells, but has failed due to water coming into the vertical wells from an acquifer underlying the reservoir. However in most situations, in the case of a virgin reservoir, this process would not be as economical or efficient as a Combined Drive-Drainage (CDD) process (See U.S. Pat. No. 5,273,111 assigned to Amoco Corporation) or a Steam Assisted Gravity Drainage (SAGD) process. In this sense, it is not necessary to create voidage in the reservoir by having it "pumped-off." Prior processes that improved the permeability or reservoir communication and the mobility of the oil are highly desirable; heating the oil and fracturing the reservoir are desirable examples. Fracturing is useful in certain situations, but it is not always necessary. Increased mobility is always desirable. The creation of voidage in the reservoir prior to the use of the inventive process is highly desirable if mobility is poor in order to improve steam injectivity.

Figure 3:
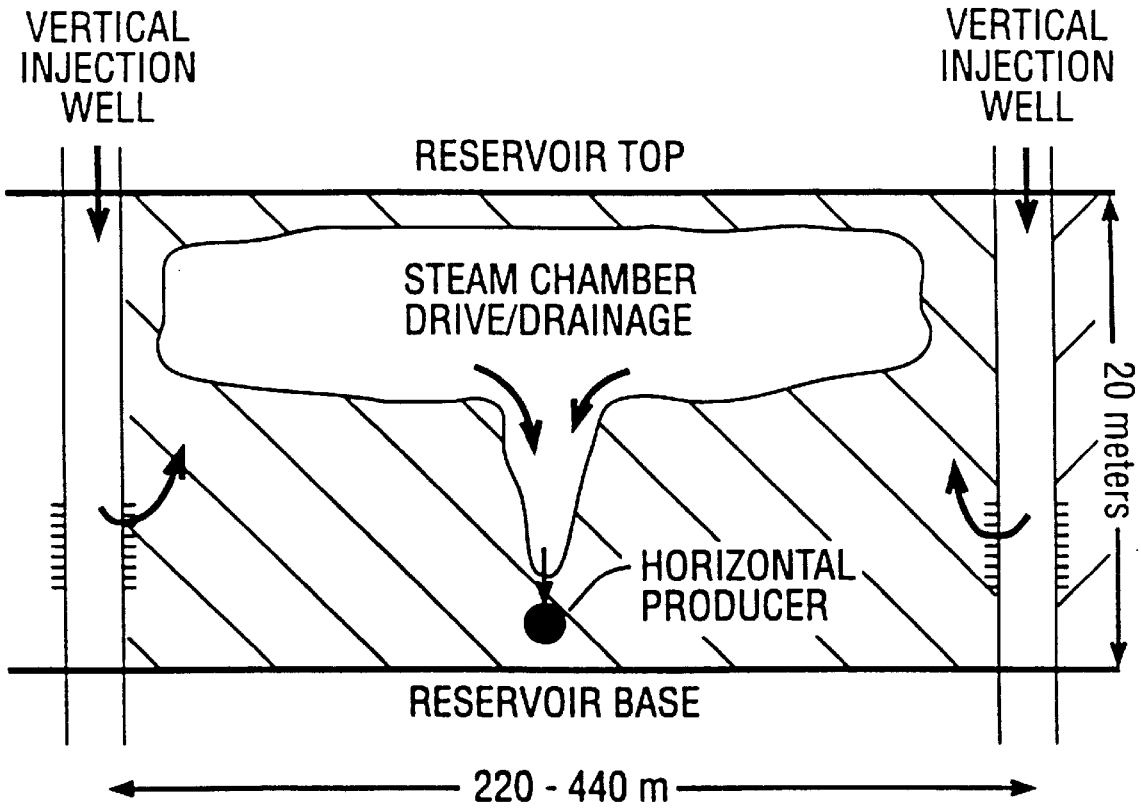
FIG. 3 is a cross-sectional schematic diagram of the vertical and horizontal wells of the process that is the subject of the present invention.

Referring to FIG. 3, the recovery scheme or process involves drilling one or more horizontal wells between rows of existing vertical wells at the base of a reservoir. The horizontal well is used as a production well while the existing vertical wells are used as continuous injection wells. No vertical well recompletions should be needed. The use of existing vertical wells, particularly when previously used as part of a CSS process, and the associated infrastructure adds to the overall economy and efficiency of the process.

After the horizontal wells 10 are formed, it may be desirable for the horizontal wells to undergo some cyclic steaming in order to establish inter-well communication. Next steam (or some other heated fluid) is applied to the vertical (injector) wells 15. The scheme is dominated initially by steam drive. However, after thermal communication is established between the vertical injectors 15 and the horizontal producers 10, gravity drainage dominates the recovery process. The process is enhanced by the heat left in the reservoir from cyclic steam stimulation. Reservoir fluid mobility in the affected area is higher than at virgin reservoir conditions so inter-well communication and production are accelerated. Further, the process steam requirements are lessened because of any heat left behind from the preceding process. Reservoir simulation indicates that this follow-up process could improve ultimate recovery to as high as 50% of the original oil in place.

Referring to the drawings, one embodiment of the invention well be tested at the Wolf Lake region in Alberta, Canada. The horizontal wells 10 were drilled from a new pad located roughly 600 meters southeast of an existing pad 12 into the reservoir for a length of approximately 1280 meters. Each horizontal well 10 has four main parts: a conductor pipe, a surface casing, an intermediate casing, and a horizontal slotted liner section. The conductor pipe (339.7 mm, K-55 MFK, 81.1 kg/m) was set at 20 meters TVD and cemented (¾" Construction Cement, 3000 psi) to the surface. The surface casing was cemented to a depth of approximately 150 meters. An intermediate hole was drilled utilizing a stabilized mud motor assembly and a MWD (measurement while drilling) system. The well was kicked-off at a depth between 50 mKB and 150 mKB, with a 6°/30 meter build rate utilized to intersect the pay zone at 90° at an approximate depth of 465 meters true vertical depth (800 meters measured depth). A 298.5 mm intermediate casing (L-80 SL, 59.52 kg/m) was run to this depth and cemented to the surface with a thermal cement (Class C+40% silica flour). An MWD dual induction or gammaray log was run on the intermediate hole. A 222 mm horizontal hole was drilled using a slick mud motor assembly and a MWD system for a total 1280 meter horizontal displacement within a 2 meter vertical target. Finally, a 177.8 mm slotted liner (K-55, LT&C, 34.22 kg/m) was run, which was not cemented.

Figure 2:
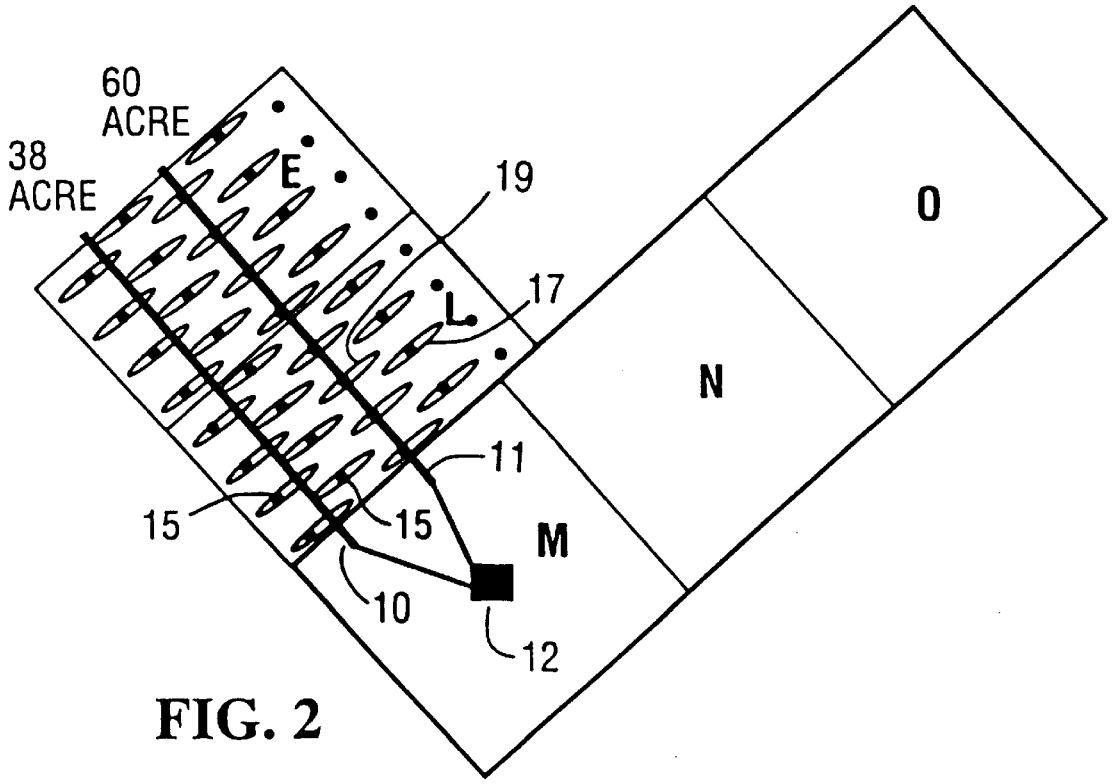
FIG. 2 is a plan view of another arrangement of vertical and horizontal wells for the process that is the subject of the present invention.

As shown in FIG. 2, the horizontal wells extend beneath pads E, L and M. Pads E, L and M were mature pads that can no longer economically be cyclically steamed. Their production histories are summarized in Table 1.

TABLE 1

Cumulative Recovery through April 1, 1993

| PAD (cycles) | Total/Average Cubic Meters | CSOR | CWOR | Recovered C2/C3/C5 |
|---|---|---|---|---|
| E(6) | 121304/6065 | 6.513 | 5.382 | 0.155 |
| L(7) | 124592/6922 | 6.857 | 5.008 | 0.145 |
| M(5) | 123212/7701 | 6.364 | 4.535 | 0.122 |

CSOR = Cumulative Steam Oil Ratio
CWOR = Cumulative Water Oil Ratio

Two pattern areas and configurations were tested using computer simulation. In FIG. 2, the two horizontal wells 10 and 11 are approximately 165 meters apart. One horizontal well 10 was drilled between two rows of existing vertical wells 15 having an effective pattern area of approximately 38 acres. The second well 11 was drilled immediately adjacent to one row of vertical wells 19 and between two rows 15 and 17 of vertical wells to support production. Its effective pattern area is estimated to be 60 acres. The vertical wells 19 immediately adjacent to the horizontal well 11 on the 60 acre spacing are not part of the method. Future horizontal well spacing may depend on production results of and on the spacing of existing vertical wells.

The orientation of the horizontal wells can be either parallel (FIG. 1) or perpendicular (FIG. 2) to a fracture trend or a major permeability trend found in the reservoir. The term "major permeability trend" refers to the preferred direction of permeability in a reservoir (i.e., connections between the pores in the rock formation that contain oil/gas). It results from the way in which the formation was laid down or formed (e.g., if the rock resulted from sands being deposited in a river bed, the major permeability trend would be in the direction of the river flow, as the flowing water would have washed away any fine silt previously laid down with the sand—had the silt remained it would have formed a barrier to oil flow between the resultant pores in the rock). The depletion zones take on a generally oblong shape and follow the fracture trend or major permeability trend. Reservoir simulation has shown that performance can be superior for horizontal wells oriented generally perpendicular to a fracture trend (i.e., FIG. 2) or major permeability trend.

In most situations, pressures are maintained below parting pressure (e.g., 8500 kPa). Under normal operations steam injection will occur at 4500 kPa. However, in some situations, in order to enhance injectivity by fracturing of the formation, injection pressures could temporarily exceed formation parting pressure.

Bitumen saturated unconsolidated sands form the reservoir unit in the tests performed at Wolf Lake. Examination of drill cores cut through reservoir areas showed that the reservoir is divided in descending order into C1, C2 and C3 sands. The C1 and C2 sands are separated by about 4 meters of sandy mud. The C2 and C3 sands are separated by 45 cm of interbedded sand and mud. Tight to low permeability calcite cemented sands were abundant. A stratigraphic correlation of closely spaced wells in E, L and M pads revealed that these calcite cemented sands were laterally discontinuous.

Oil sand pay in the Wolf Lake test area was estimated to be 15 m. No gas or water legs were evident. The reservoir properties are summarized as follows:

| Reservoir Unit | C3 | C2 |
|---|---|---|
| Depth of pay (meters) | 448 | 445 |
| Net oil sand pay (meters) | 15.1 | 1.8 |
| Average porosity | 32% | 28% |
| Initial water saturation | 36% | 34% |

By "net pay" is meant sand with porosity greater than or equal to 25%, $V_{sh}$ (i.e., volume of shale) less than or equal to 25% and GWO greater than 8%. GWO or "grain weight oil" is the weight percent bitumen of a dry bulk sample (water removed).

In the Wolf Lake tests, since the horizontal sections of the wells are drilled through depleted cyclic steam pads, there is some potential for drilling difficulties. Several precautions can be taken to minimize these difficulties. Temperature and fluid level surveys conducted on the existing E and L pad wells can be used to determine reservoir temperatures and pressures prior to drilling. Moreover, 2D seismic can be used to indicate temperature changes across the pattern area, which may be related to depleted areas.

There is little potential for encountering pressurized zones near the surface. Potential drilling difficulties are most likely to be either lost circulation or borehole sloughing. Lost circulation may be rectified with lost circulation materials. Observation wells may be drilled through a depleted zone to gauge the potential for sloughing, and to determine what action can be taken to remedy the problem. Finally, a directional drilling and survey program may be used to minimize interference with any existing deviated wells.

The horizontal wells can be produced using either conventional rod pumping or gas-lift systems. The wellheads in the Wolf Lake test were designed to handle the maximum steam injection pressure of 9,000 kPa (formation fracture pressure is approximately 8,500 kPa).

Vertical observation wells may be drilled over the project area to monitor pressure and temperature of the producing formation during steam injection operations. Observation well information may be collected using a datalogger located at each site. On a regular basis, the dataloggers transmit data back to a central computer, located at the main plant site, for further processing and reporting.

The first three years of operation are expected to produce 232,870 $m^3$ of oil, 1,431,530 $m^3$ of water and 2.3 MM $m^3$ of gas (average gas to oil ratio or GOR equal to 10). The cumulative steam-oil ratio (CSOR) is expected to be 5.1. The cumulative water-oil ratio (CWOR) is expected to be 6.5. Table 2 outlines the projected performance of the two combined wells.

TABLE 2

| Year | Bitumen Production $m^3/d$ | SOR Instantaneous | WOR Instantaneous |
|---|---|---|---|
| 1 | 156 | 6.7 | 9.1 |
| 2 | 236 | 4.4 | 5.6 |
| 3 | 246 | 4.3 | 4.8 |
| 4 | 296 | 3.5 | 3.8 |
| 5 | 346 | 3.0 | 3.5 |
| 6 | 225 | 4.7 | 5.0 |
| 7 | 100 | 10.5 | 9.6 |
| Average | 229 | 5.3 | 5.9 |

This information is based on numerical simulation, wherein it was assumed that the process of the invention is independent of other operations in the area. In practice, any excess water produced would be recycled to make up for shortfalls elsewhere, rather than disposed.

No modifications should be needed for the existing CSS control facilities which consist of equipment necessary for bitumen treatment, water disposal, steam generation, and fuel gas processing. Moreover, this process should not necessitate immediate or long term increase in the consumption of fresh water for steam generation. Table 3 illustrates the project steam and water requirements for the Wolf Lake test.

TABLE 3

| Year | Steam CWE (1000 $m^3$) | Produced Water (1000 $m^3$) | Make-Up Water (1000 $m^3$) | Excess Water (1000 $m^3$) |
|---|---|---|---|---|
| 1 | 381 | 518 | 0 | 137 |
| 2 | 379 | 482 | 0 | 103 |
| 3 | 386 | 431 | 0 | 45 |
| 4 | 378 | 411 | 0 | 33 |
| 5 | 379 | 442 | 0 | 63 |
| 6 | 386 | 411 | 0 | 25 |

TABLE 3-continued

| Year | Steam CWE (1000 $m^3$) | Produced Water (1000 $m^3$) | Make-Up Water (1000 $m^3$) | Excess Water (1000 $m^3$) |
|---|---|---|---|---|
| 7 | 383 | 350 | 0 | — |
| Cumulative | 2672 | 3045 | 0 | 406 |

This information is based on numerical simulation, wherein it was assumed that the process of the invention is independent of other operations in the area. In practice, any excess water produced would be recycled to make up for shortfalls elsewhere, rather than disposed.

It should be noted that the simulation predicted greater water production than steam injection. This imbalance results because the produced fluids that are drained from the steam chamber have a greater volume than the condensed equivalent volume of steam. Moreover, since the selected reservoir has higher than virgin water saturation due to prior cyclic steam operations, this also contributed to the imbalance.

From the foregoing description, it will be observed that numerous variations, alternatives and modifications will be apparent to those skilled in the art. Accordingly, this description is to be construed as illustrative only and is for the purpose of teaching those skilled in the art the manner of carrying out the invention. Various changes may be made, materials substituted and features of the invention may be utilized. For example, the invention is applicable to reservoirs that have been depleted through water-flooding as well as to fractured and non-fractured reservoirs. Moreover, while steam is the preferred fluid, other fluids, such as hot water, having a temperature greater than that of the underground formation, should be considered. In addition, the process of the invention may be applied to wells where prior production was achieved through primary pumping or other means. The process of the invention is applicable to almost any heavy oil reservoir where prior production has been attempted through almost any means involving the use of laterally spaced non-horizontal wells (e.g., slant hole, vertical and directionally drilled). Moreover, to a limited extent the process of the invention can also be applied in a heavy oil reservoir where substantial prior production has not occurred. Thus, the process of the invention is not to be limited to being used as a follow-up to cyclic steam simulation. As long as there is mobility and communication, then the process of the invention can be applied; voidage is needed if mobility and communication are not present. Thus, it will be appreciated that various modifications, alternatives, variations, etc., may be made without departing from the spirit and scope of the invention as defined in the appended claims. It is, of course, intended to cover by the appended claims all such modifications involved within the scope of the claims.

We claim:

1. In a heavy oil reservoir having a plurality of laterally separated generally vertical wells whose use have left the reservoir characterized by at least one of a heated depletion zone, a channel, voidage and oil that is mobile and communicative within the reservoir, the reservoir having a top and a bottom and each vertical well having a lower end located within at least part of the reservoir, a thermal recovery process comprising the steps of:

a) drilling a well having a horizontal section and an opening in said section that is located laterally between at least two of the vertical wells and at a depth within the lower part of the reservoir;

b) injecting a heated fluid through said at least two vertical wells to establish thermal communication with said horizontal well, the location where said heated fluid leaves the lower ends of the vertical wells being relatively close to said opening in said horizontal section; and c) using the pressure drive of said heated fluid and gravity drainage to recover oil from the reservoir through said horizontal well.

2. The process of claim 1, wherein step (b) is performed using steam as the heated fluid.

3. The process of claim 2, where in step (b) said steam is injected continuously through the vertical wells at a high rate and below the fracture pressure of the reservoir.

4. The process of claim 3, where the fracture pressure is exceeded.

5. The process of claim 2, further including the step of cyclically steaming said horizontal well to establish inter-well communication prior to using the combination of steam drive and gravity drainage to recover oil through said horizontal well.

6. The process of claim 2, where in step (b) the drive of said steam injected through the vertical wells dominates over gravity drainage for a predetermined time interval.

7. The process of claim 6, wherein after said predetermined time interval gravity drainage dominates over the drive of said steam.

8. The process of claim 1, wherein the reservoir is a heavy oil reservoir that has been at least partially depleted through water flooding prior to performing step (a).

9. The process of claim 1, wherein the reservoir was at least partially depleted under cold flow production prior to performing step (a).

10. The process of claim 9, wherein said cold flow production included the formation of wormholes that are in communication with at least one of the vertical wells.

11. The process of claim 1, wherein prior to performing step (a), fractures were formed in the reservoir, and at least one of said fractures is in proximity to at least one vertical well.

12. The process of claim 1, wherein at least one of the two vertical wells and said horizontal well intersect a high-mobility pre-heated channel that was formed in the reservoir during cyclic steam stimulation.

13. The process of claim 1, wherein prior to injecting said heated fluid through the two vertical wells, the reservoir is pumped-off.

14. The process of claim 1, wherein said horizontal well has a build section located outside of the known extent of the depleted reservoir.

15. The process of claim 1, wherein the reservoir has at least one of a predetermined fracture direction and a major permeability trend direction; and in step (a) said horizontal well is drilled generally perpendicular to said direction.

16. The process of claim 1, wherein the reservoir is characterized by a fracture pressure, and where in step (b) said heated fluid is injected at a pressure that is less than said fracture pressure.

17. The process of claim 1, wherein the reservoir is characterized by a fracture pressure, and in step (b) said heated fluid is injected at a pressure to exceed said fracture pressure.

18. The process of claim 1, where in step (b) heated fluid is injected mostly at a depth that is within said lower part of the reservoir.

19. The process of claim 1, wherein said generally vertical wells are directionally drilled slant wells.

20. The process of claim 1, wherein at least one of the vertical wells was used for cyclic steam stimulation of the reservoir such that the oil within the reservoir is characterized by mobility and communication.

21. In an at least partially depleted oil reservoir containing at least four generally vertical wells that have been used for cyclic steam stimulation and that have left in the reservoir at least one high-mobility pre-heated channel that was formed in the reservoir during cyclic steam stimulation, the vertical wells having bottom ends located within said reservoir and upper ends that define a quadrilateral on the surface of the earth, the reservoir having at least one of a predetermined fracture direction and a major permeability trend direction, a thermal recovery process comprising the steps of:

a) drilling a horizontal well generally perpendicular to the direction of at least one of the fracture trend and the major permeability trend, said horizontal well having a horizontal section that is located in the lateral space between two opposite sides of the quadrilateral formed by the four generally vertical wells and that is located at the lower part of the reservoir, at least one of the four generally vertical wells and said horizontal well generally intersecting a high-mobility pre-heated channel that was formed in the reservoir during cyclic steam stimulation, said horizontal well having a build section located outside of the known lateral extent of the at least partially depleted oil reservoir and having openings in said horizontal section that are located between the vertical wells;

b) cyclically steaming said horizontal well and at least two of the four generally vertical wells to establish inter-well communication;

c) continuously injecting steam through said at least two generally vertical wells to thermally communicate with said horizontal section, the location where said steam leaves said at least two generally vertical wells being relatively close to said openings in said horizontal section and the pressure of said steam is less than the fracture pressure of the reservoir; and d) using the driving force of said steam to recover heated oil from the reservoir through said horizontal well for a predetermined time interval and thereafter using gravity drainage to recover oil from said reservoir.

22. In an at least partially depleted heavy oil reservoir containing rows of generally vertical wells that have been used for cyclic steam stimulation and that have left in the reservoir at least one high-mobility pre-heated channel that was formed in the reservoir during cyclic steam stimulation, the reservoir having at least one predetermined fracture direction or major permeability trend direction, a thermal recovery process comprising the steps of:

a) drilling, in the reservoir in a direction generally perpendicular to the direction of the fracture or the major permeability trend, a horizontal well having a horizontal section that is located in the lateral space between the two rows of vertical wells and that is located at a depth at the lower part of the reservoir, at least one of the vertical wells and said horizontal well intersecting a high-mobility pre-heated channel that was formed in the reservoir during cyclic steam stimulation;

b) continuously injecting steam, through said at least said one vertical well and an adjacent vertical well in the opposite row, to thermally communicate with said horizontal well, the pressure of said steam being less than the fracture pressure of the reservoir; and c) using the combination of the drive of said steam and gravity drainage to recover oil from the reservoir through said horizontal well.

23. The process of claim 22, wherein the reservoir is a heavy oil reservoir that has also been at least partially depleted through water flooding, performed at least as early as subsequent to said application of cyclic steam stimulation to the reservoir.

24. The process of claim 22, wherein the reservoir has also been depleted under primary production without fracturing, prior to said application of cyclic steam stimulation to the reservoir.

25. The process of claim 22, wherein after the performance of step (a) and prior to completing step (b) the reservoir is pumped-off.

26. The process of claim 22, wherein said steam drive recovers oil from the reservoir more than gravity drainage recovers oil from the reservoir for a predetermined time interval.

27. The process of claim 22, wherein the reservoir has been at least partially depleted under primary production with the formation of wormholes.

28. In a heavy oil reservoir which has not been signficantly produced or depleted by prior production methods, which has a top and a bottom and which contains oil that is mobile, a thermal recovery process comprising the steps of:

a) drilling in the reservoir at least two generally vertical wells, for determining the potential of the reservoir to produce oil each well having a lower end located within at least part of the reservoir;

b) drilling a horizontal well having a horizontal section and an opening in said section that is located laterally between at least two of said vertical wells and that is at a depth near the bottom of the reservoir;

c) injecting a heated fluid through said at least two generally vertical wells to establish thermal communication with said horizontal section of said horizontal well, said heated fluid leaving said lower ends of said vertical wells at a location that is near said opening in said horizontal section; and d) using the pressure drive of said heated fluid and gravity drainage to recover oil from the reservoir through said horizontal well.

29. The process of claim 28, wherein step (c) is performed using steam as the heated fluid.

30. The process of claim 29, where in step (c) said steam is injected continuously through the vertical wells at a high rate and below the fracture pressure of the reservoir.

31. The process of claim 28, where in step (c) said heated fluid is initially and temporarily injected through the vertical well at a high rate such that the fracture pressure of the reservoir is temporarily exceeded in order to enhance injectivity.

32. The process of claim 29, where step (b) further includes the step of cyclically steaming said horizontal well to establish inter-well communication prior to using the combination of steam drive and gravity drainage to recover oil through said horizontal well.

33. The process of claim 32, where in step (c) and prior to step (d), the drive of said steam injected through the vertical wells dominates over gravity drainage for a predetermined time interval.

34. The process of claim 28, wherein prior to performing step (a), fractures were formed in the reservoir; and at wherein least one of said fractures is in proximity to at least one vertical well.

35. The process of claim 28, where in step (c) and prior to injecting said heated fluid through the two vertical wells, the reservoir is pumped-off.

36. The process of claim 28, where in step (b) said horizontal well has a build section located outside of the known extent of the reservoir.

37. The process of claim 35, wherein a high-mobility pre-heated channel that was formed in the reservoir during cyclic steam stimulation is intersected by at least one of the two vertical wells and said horizontal well.

38. The process of claim 28, wherein the reservoir has at least one of a predetermined fracture direction and a major permeability trend direction; and in step (b) said horizontal well is drilled generally perpendicular to said direction.

39. The process of claim 28, where the reservoir is characterized by a fracture pressure, and where in step (c) said heated fluid is injected at a pressure that is less than said fracture pressure.

40. The process of claim 39, wherein said heated fluid is injected to exceed said fracture pressure.

41. The process of claim 28, wherein the reservoir is characterized by a plurality of fractures having a general predetermined direction and wherein said horizontal section is located to be generally perpendicular to said predetermined direction of said fractures and in close proximity to said fractures.

* * * * *